US005434482A

United States Patent [19]

Borowiec et al.

[11] Patent Number: 5,434,482

[45] Date of Patent: Jul. 18, 1995

[54] ELECTRODELESS FLUORESCENT LAMP WITH OPTIMIZED AMALGAM POSITIONING

[75] Inventors: Joseph C. Borowiec, Schenectady; Hsueh-Rong Chang, Scotia; Robert A. Senecal, Schenectady, all of N.Y.

[73] Assignee: General Electric Company, Schenectady, N.Y.

[21] Appl. No.: 130,935

[22] Filed: Oct. 4, 1993

[51] Int. Cl.[6] ..... H05B 41/16

[52] U.S. Cl. ..... 315/248; 315/57; 315/267; 313/493; 313/490

[58] Field of Search ..... 315/248, 112, 117, 57, 315/267; 313/490, 493, 545, 550

[56] References Cited

U.S. PATENT DOCUMENTS

| | | | |
|---|---|---|---|
| 4,010,400 | 3/1977 | Hollister | 315/248 |
| 4,017,764 | 4/1977 | Anderson | 315/57 X |
| 4,262,231 | 4/1981 | Anderson et al. | 313/490 |
| 4,437,041 | 3/1984 | Roberts | 315/248 |
| 4,622,495 | 11/1986 | Smeelen | 315/248 |
| 4,728,867 | 3/1988 | Postma et al. | 315/248 |

FOREIGN PATENT DOCUMENTS 0252548 1/1988 European Pat. Off. .

*Primary Examiner*—Robert J. Pascal
*Assistant Examiner*—Haissa Philogene
*Attorney, Agent, or Firm*—Jill M. Breedlove; Marvin Snyder

[57] ABSTRACT

An amalgam is accurately placed and retained in an optimal location near the cold spot of an electrodeless SEF lamp for operation at a mercury vapor pressure in the optimum range from approximately four to seven millitorr. The amalgam is positioned at the tip of an extended exhaust tube near the apex of the lamp envelope by forming an indentation in the exhaust tube and, in some embodiments, a dose locating member in combination therewith. An evacuation hole is formed below the indentation for evacuation of the lamp envelope, or bulb, during lamp fabrication. In an alternative embodiment, the extension of the exhaust tube is situated perpendicular to the main portion of the tube to allow for lateral adjustment of the position of the amalgam, thereby allowing for even further control of the amalgam operating temperature.

20 Claims, 3 Drawing Sheets

ELECTRODELESS FLUORESCENT LAMP WITH OPTIMIZED AMALGAM POSITIONING

The present invention is related to commonly assigned U.S. patent application Ser. No. of J. C. Borowiec, K. J. Downton and S. El-Hamamsy, filed concurrently herewith and incorporated by reference herein.

FIELD OF THE INVENTION

The present invention relates generally to fluorescent lamps and, more particularly, to accurate placement and retention of an amalgam in a solenoidal electric field fluorescent discharge lamp for optimally controlling mercury vapor pressure therein, which amalgam placement and retention do not interfere with lamp processing and furthermore are maintained during lamp operation, regardless of lamp orientation.

BACKGROUND OF THE INVENTION

The optimum mercury vapor pressure for production of 2537 Å radiation to excite a phosphor coating in a fluorescent lamp is approximately six millitorr, corresponding to a mercury reservoir temperature of approximately 40° C. Conventional tubular fluorescent lamps operate at a power density (i.e., typically measured as power input per phosphor area) and in a fixture configured to ensure operation of the lamp at or about a mercury vapor pressure of six millitorr (typically in a range from approximately four to seven millitorr); that is, the lamp and fixture are designed such that the coolest location (i.e., cold spot) of the fluorescent lamp is approximately 40° C. Compact fluorescent lamps, however, including electrodeless solenoidal electric field (SEF) fluorescent discharge lamps, operate at higher power densities with the cold spot temperature typically exceeding 50° C. As a result, the mercury vapor pressure is higher than the optimum four to seven millitorr range, and the luminous output of the lamp is decreased.

One approach to controlling the mercury vapor pressure in an SEF lamp is to use an alloy capable of absorbing mercury from its gaseous phase in varying amounts, depending upon temperature conditions. Alloys capable of forming amalgams with mercury have been found to be particularly useful. The mercury vapor pressure of such an amalgam at a given temperature is lower than the mercury vapor pressure of pure liquid mercury.

Unfortunately, accurate placement and retention of an amalgam to achieve a mercury vapor pressure in the optimum range in an SEF lamp are difficult. For stable long-term operation, the amalgam should be placed and retained in a relatively cool location with minimal temperature variation. Such optimal locations are at or near the tip, or apex, of the lamp envelope, or crown. Accordingly, it is desirable to place the amalgam in an optimal position near the cold spot of the lamp. Moreover, to achieve the desired beneficial effects of an amalgam in an SEF lamp, the amalgam should maintain its composition and optimized location during lamp processing and manufacturing steps as well as during lamp operation.

SUMMARY OF THE INVENTION

An amalgam is accurately placed and retained in an optimal location near the cold spot of an electrodeless SEF lamp for operation at a mercury vapor pressure in the optimal range from approximately four to seven millitorr. The amalgam is positioned at the tip of an exhaust tube extension near the apex of the lamp envelope by forming an indentation therein and, in some embodiments, using a dose locating member in combination with the indentation. An evacuation hole is formed below the indentation for evacuation of the lamp envelope, or bulb, during lamp fabrication.

In an alternative embodiment, the exhaust tube extension is situated perpendicular to the main portion of the tube to allow for lateral adjustment of the position of the amalgam, thereby allowing for even further control of the amalgam operating temperature.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
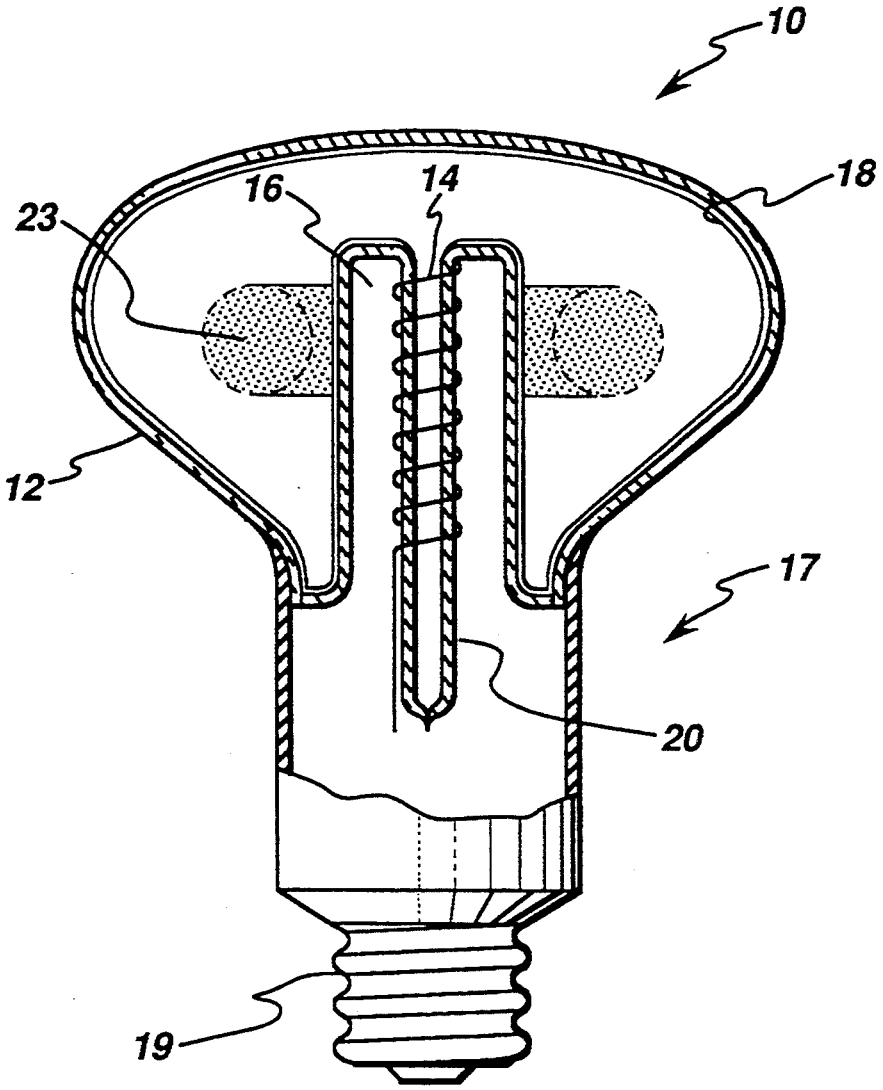
fig. 1 PRIOR ART
FIG. 1 illustrates, in partial cross section, a typical electrodeless SEF fluorescent discharge lamp.

FIG. 1 illustrates a typical electrodeless SEF fluorescent discharge lamp 10 having an envelope 12 containing an ionizable gaseous fill. A suitable fill, for example, comprises a mixture of a rare gas (e.g., krypton and/or argon) and mercury vapor and/or cadmium vapor. An excitation coil 14 is situated within, and removable from, a re-entrant cavity 16 within envelope 12. For purposes of illustration, coil 14 is shown schematically as being wound about an exhaust tube 20 which is used for filling the lamp. However, the coil may be spaced apart from the exhaust tube and wound about a core of insulating material or may be free standing, as desired. The interior surfaces of envelope 12 are coated in well-known manner with a suitable phosphor 18. Envelope 12 fits into one end of a base assembly 17 containing a radio frequency power supply (not shown) with a standard (e.g., Edison type) lamp base 19 at the other end. Envelope 12 is shown in FIG. 1 in a "crown-up", or "base-down", position.

In operation, current flows in coil 14 as a result of excitation by a radio frequency power supply (not shown). As a result, a radio frequency magnetic field is established within envelope 12 which ionizes and excites the gaseous fill contained therein, resulting in an ultraviolet discharge 23. Phosphor 18 absorbs the ultraviolet radiation and emits visible radiation as a consequence thereof.

In accordance with the present invention, a properly constituted amalgam is accurately placed and retained in an optimal location in an SEF lamp for operation at a mercury vapor pressure in the optimum range from approximately four to seven millitorr, which amalgam maintains its composition and location during lamp processing as well as during lamp operation, regardless of lamp orientation. In particular, the amalgam is accurately positioned and retained at a relatively cool location with minimal temperature variation near the apex of the lamp envelope. The apex of the lamp envelope typically comprises the cold spot of the lamp.

An exemplary amalgam comprises a combination of bismuth and indium. Another exemplary amalgam comprises pure indium. Still another exemplary amalgam comprises a combination of lead, bismuth and tin, such as described in commonly assigned U.S. Pat. No. 4,262,231 of J. M. Anderson and P. D. Johnson, issued Apr. 14, 1981, which is incorporated by reference herein. Yet another amalgam may comprise zinc. And yet another amalgam may comprise a combination of zinc, indium and tin. Each amalgam has its own optimum range of operating temperatures.

Figure 2:
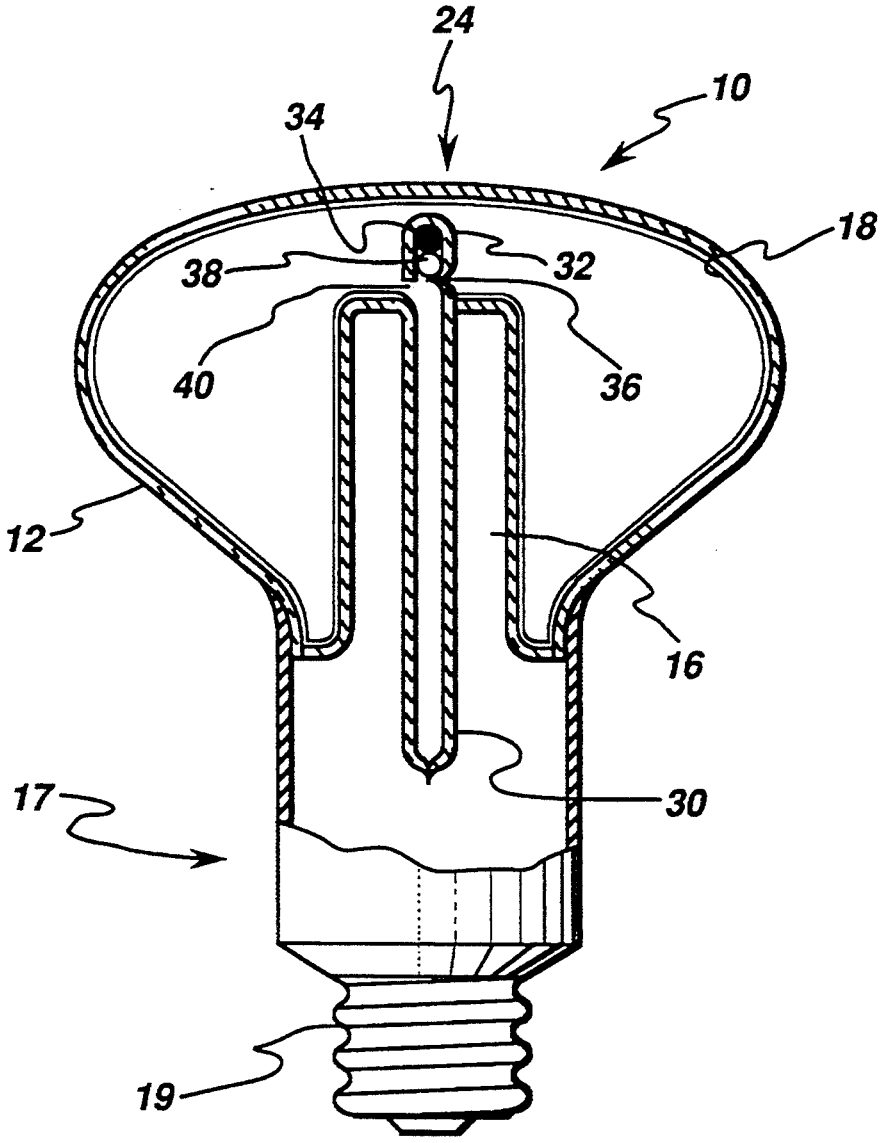
FIG. 2 illustrates, in partial cross section, an electrodeless SEF fluorescent discharge lamp according to one embodiment of the present invention.

FIG. 2 illustrates an electrodeless SEF lamp in accordance with one embodiment of the present invention. The SEF lamp of FIG. 2 includes an extended exhaust tube 30; that is, exhaust tube 30 has an extension 32 through re-entrant cavity 16 for positioning an amalgam 34 near the apex 24 of the lamp. Before the lamp is filled through exhaust tube 30, amalgam 34 is inserted through the exhaust tube with lamp 10 in a crown-down position. Then, an indentation 36, shown in FIG. 2 as being relatively sharp, is formed in the exhaust tube for holding amalgam 32 in place. The location of indentation 36 depends on the optimum operating temperature range for the particular amalgam employed. If desired, a dose locating member 38 comprising, for example, a glass ball, may be inserted after amalgam 34 to further ensure that amalgam 34 maintains its position toward or at the end of extension 32. A hole 40 is formed in exhaust tube 30, and envelope 12 is evacuated and filled therethrough.

Figure 3:
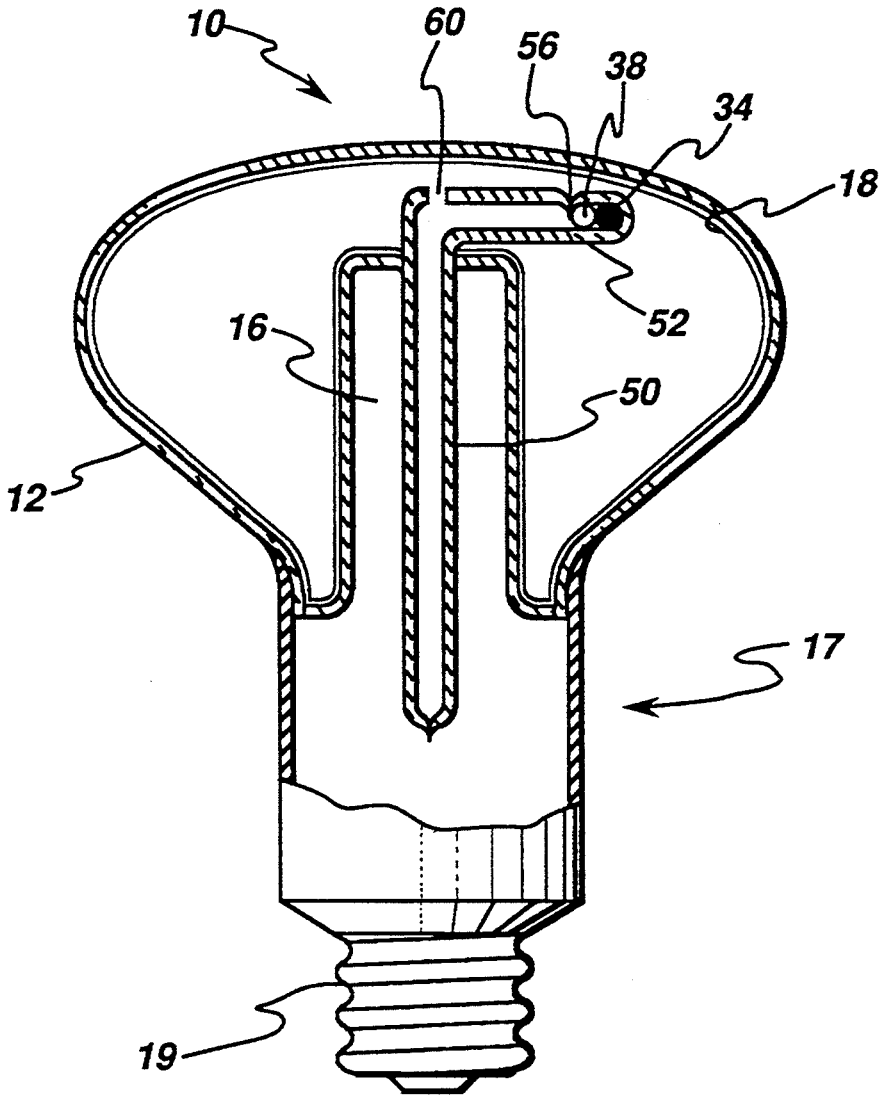
FIG. 3 illustrates, in partial cross section, an electrodeless SEF fluorescent discharge lamp according to an alternative embodiment of the present invention.

FIG. 3 illustrates an alternative embodiment of the present invention wherein an extension 52 of an extended exhaust tube 50 is positioned substantially perpendicular to the main portion of the exhaust tube. Amalgam 34 is positioned in extension 52 of exhaust tube 50 by forming an indentation 56 therein in similar manner as described with reference to indentation 36 of FIG. 2. As shown, dose locating member 38 may be employed, if desired, to further ensure that amalgam 34 maintains its position. Evacuation hole 60 is formed in exhaust tube 50, and envelope 12 is evacuated and filled therethrough. Advantageously, by the embodiment of FIG. 3, the amalgam position may be controlled laterally as well as vertically, thus providing even further operating temperature control for amalgam 34.

Of course, those of ordinary skill in the art will understand that the principles of the present invention are applicable to electroded fluorescent discharge lamps as well as electrodeless fluorescent discharge lamps.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for manufacturing a solenoidal electric field (SEF) fluorescent discharge lamp, comprising the steps of:

providing a light-transmissive envelope having an interior phosphor coating for emitting visible radiation when excited by ultraviolet radiation, said envelope having an apex portion, said envelope further having a re-entrant cavity formed therein for containing an excitation coil, said re-entrant cavity having an exhaust tube with an extension toward said apex portion of said envelope, said extension having a tip;

inserting an amalgam into said exhaust tube and maintaining said amalgam substantially at said tip of said extension thereof;

forming an indentation in said exhaust tube at a predetermined location between said re-entrant cavity and said tip of said extension of said exhaust tube;

forming an evacuation hole in said exhaust tube between said indentation and said re-entrant cavity; and evacuating and filling said envelope through said exhaust tube.

2. The method of claim 1 wherein said predetermined location is such that mercury vapor pressure within said envelope is maintained within the range from approximately four to seven millitorr during lamp operation.

3. The method of claim 1 further comprising the step of inserting a dose locating member into said exhaust tube after inserting said amalgam and before forming said indentation.

4. The method of claim 3 wherein said dose locating member comprises a glass ball.

5. The method of claim 1 wherein said amalgam is selected from the group consisting of: indium; a combination of bismuth and indium; a combination of lead, bismuth and tin; zinc; and a combination of zinc, indium and tin.

6. A method for manufacturing a solenoidal electric field (SEF) fluorescent discharge lamp, comprising the steps of:

providing a light-transmissive envelope having an interior phosphor coating for emitting visible radiation when excited by ultraviolet radiation, said envelope having an apex portion, said envelope further having a re-entrant cavity formed therein for containing an excitation coil, said re-entrant cavity having an exhaust tube with an extension toward said apex portion of said envelope, said extension being situated perpendicular to said exhaust tube and said re-entrant cavity, said extension having a tip;

inserting an amalgam into said exhaust tube and maintaining said amalgam substantially at said tip of said extension thereof;

forming an indentation in said exhaust tube at a predetermined location between said re-entrant cavity and said tip of said extension of said exhaust tube;

forming an evacuation hole in said exhaust tube between said indentation and said re-entrant cavity; and evacuating and filling said envelope through said exhaust tube.

7. The method of claim 6 wherein said predetermined location is such that mercury vapor pressure within said envelope is maintained within the range from approximately four to seven millitorr during lamp operation.

8. The method of claim 6 further comprising the step of inserting a dose locating member into said exhaust tube after inserting said amalgam and before forming said indentation.

9. The method of claim 8 wherein said dose locating member comprises a glass ball.

10. The method of claim 6 wherein said amalgam is selected from the group consisting of: indium; a combination of bismuth and indium; a combination of lead, bismuth and tin; zinc; and a combination of zinc, indium and tin.

11. A fluorescent discharge lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation, said envelope having an apex portion, said envelope further having a re-entrant cavity formed therein;

an excitation coil contained within said re-entrant cavity for providing said radio frequency magnetic field when excited by a radio frequency power supply;

an exhaust tube having an extension extending through said re-entrant cavity and toward said apex portion of said envelope, said exhaust extension having a tip;

an indentation formed in said exhaust tube at a predetermined location between said re-entrant cavity and said tip of said extension of said exhaust tube;

an amalgam situated within said exhaust tube and maintained in position substantially at said tip of said extension by said indentation.

12. The lamp of claim 11 wherein said predetermined location is such that mercury vapor pressure within said envelope is maintained within the range from approximately four to seven millitorr during lamp operation.

13. The lamp of claim 11 further comprising a dose locating member for operating in combination with said indentation to maintain said amalgam in position is said exhaust tube.

14. The lamp of claim 13 wherein said dose locating member comprises a glass ball.

15. The lamp of claim 11 wherein said amalgam is selected from the group consisting of: indium; a combination of bismuth and indium; a combination of lead, bismuth and tin; zinc; and a combination of zinc, indium and tin.

16. A fluorescent discharge lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation, said envelope having an apex portion, said envelope further having a re-entrant cavity formed therein;

an excitation coil contained within said re-entrant cavity for providing said radio frequency magnetic field when excited by a radio frequency power supply;

an exhaust tube having an extension extending through said re-entrant cavity and toward said apex portion of said envelope, said extension being situated perpendicular to said exhaust tube and said re-entrant cavity, said extension having a tip;

an indentation in said exhaust tube at a predetermined location between said re-entrant cavity and said tip of said extension of said exhaust tube;

an amalgam situated within said exhaust tube and maintained in position substantially at said tip of said extension by said indentation.

17. The lamp of claim 16 wherein said predetermined location is such that mercury vapor pressure within said envelope is maintained within the range from approximately four to seven millitorr during lamp operation.

18. The lamp of claim 16 further comprising a dose locating member for operating in combination with said indentation to maintain said amalgam in position is said exhaust tube.

19. The lamp of claim 18 wherein said dose locating member comprises a glass ball.

20. The lamp of claim 11 wherein said amalgam is selected from the group consisting of: indium; a combination of bismuth and indium; a combination of lead, bismuth and tin; zinc; and a combination of zinc, indium and tin.

* * * * *